US008667638B2

(12) United States Patent
Kim et al.

(10) Patent No.: US 8,667,638 B2
(45) Date of Patent: Mar. 11, 2014

(54) ROBOT CLEANER

(75) Inventors: Bongju Kim, Seoul (KR); Sangyun Kim, Seoul (KR); Jongil Park, Seoul (KR); Woojin Choi, Seoul (KR); Dongmyung Shin, Seoul (KR); Hoseon Rew, Seoul (KR); Sangjo Kim, Seoul (KR); Younggyu Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 520 days.

(21) Appl. No.: 12/916,963

(22) Filed: Nov. 1, 2010

(65) Prior Publication Data

US 2011/0099747 A1 May 5, 2011

(30) Foreign Application Priority Data

Nov. 2, 2009 (KR) ..... 10-2009-0105147
Nov. 16, 2009 (KR) ..... 10-2009-0110434
Nov. 17, 2009 (KR) ..... 10-2009-0111120

(51) Int. Cl.
*A47L 9/28* (2006.01)
*A47L 5/00* (2006.01)

(52) U.S. Cl.
USPC ..... 15/319; 15/347; 15/340.1

(58) Field of Classification Search
USPC ..... 15/347, 346, 327.7, 354, 319, 340.1, 15/339
See application file for complete search history.

(56) References Cited

U.S. PATENT DOCUMENTS

| | | | | |
|---|---|---|---|---|
| 5,787,545 | A | 8/1998 | Colens | |
| 7,108,731 | B2 * | 9/2006 | Park et al. | 55/356 |
| 7,320,149 | B1 * | 1/2008 | Huffman et al. | 15/320 |
| 7,779,504 | B2 * | 8/2010 | Lee et al. | 15/319 |
| 8,065,778 | B2 * | 11/2011 | Kim et al. | 15/319 |
| 2008/0235897 | A1 * | 10/2008 | Kim et al. | 15/319 |
| 2009/0100630 | A1 * | 4/2009 | Kim et al. | 15/319 |

FOREIGN PATENT DOCUMENTS

| | | | |
|---|---|---|---|
| DE | 102007009109 | A1 | 4/2008 |
| EP | 0635236 | A1 | 1/1995 |
| EP | 0803224 | A2 | 10/1997 |
| GB | 2344745 | A | 6/2000 |
| WO | WO 2008/007830 | A1 | 1/2008 |

* cited by examiner

*Primary Examiner* — Dung Van Nguyen
(74) *Attorney, Agent, or Firm* — Birch, Stewart, Kolasch & Birch, LLP

(57) ABSTRACT

A robot cleaner comprises a main body having a suction port at a bottom surface thereof, a pair of wheel assemblies disposed at both sides of the main body, and configured to move the main body, a dust box mounted to contact the bottom surface of the main body, and configured to collect dust sucked through the suction port, a filter unit configured to filter air discharged from the dust box, a suction fan configured to form a suction pressure on a suction channel defined by the suction port, the dust box and the filter unit, and a battery disposed at a side of the dust box.

12 Claims, 10 Drawing Sheets

ROBOT CLEANER

CROSS-REFERENCE TO A RELATED APPLICATION

Pursuant to 35 U.S.C. §119(a), this application claims the benefit of earlier filing date and right of priority to Korean Application No. 10-2009-0105147 filed on Nov. 2, 2009, 10-2009-0110434 filed on Nov. 16, 2009 and 10-2009-0111120 filed on Nov. 17, 2009, the content of which is incorporated by reference herein in its entirety.

BACKGROUND OF THE INVENTION

1. Field of the Invention

The present invention relates to a robot cleaner.

2. Background of the Invention

A cleaner is an apparatus configured to clean an indoor room by removing foreign materials. As the cleaner, generally used is a vacuum cleaner configured to suck foreign materials by using a suction force of a low pressure part. Recently, is being developed a robot cleaner capable of removing foreign materials from an indoor floor with autonomously moving through an automatic running function.

The robot cleaner includes a distance sensor configured to sense a distance of an obstacle such as furniture, office supplies, and a wall inside a cleaning area, and a wheel assembly configured to move the robot cleaner. The wheel assembly includes wheels provided at right and left sides of a robot cleaner main body, and a motor configured to rotate the wheels. The robot cleaner senses peripheral situations by the distance sensor, etc., and controls the motor, thereby performing indoor cleaning through autonomous running.

A suction means is provided in the robot cleaner main body, and a suction opening configured to suck dust is provided on a lower surface of the robot cleaner main body. An agitator configured to brush up dust of the bottom of the cleaning area is rotatably mounted to the suction opening. And, a filter configured to filter foreign materials included in air sucked from the bottom is provided on an air moving path inside the robot cleaner. While moving in the cleaning area, the robot cleaner autonomously performs a cleaning operation by sucking dust of the bottom into the robot cleaner main body and thereby collecting the dust into the filter, through a suction force by the suction means and rotations of the agitator. The collected dust is stored in a dust box inside the robot cleaner.

FIG. 1 is a side sectional view schematically showing a robot cleaner in accordance with the conventional art. Main components of the conventional robot cleaner will be explained in brief. A battery 10 having a rectangular shape is provided in the robot cleaner in a rechargeable manner so as to supply power for operating the robot cleaner. Due to a heavy weight, the battery is generally positioned on a central bottom surface of the robot cleaner, such that the robot cleaner performs a cleaning operation while smoothly moving in a balanced state. The dust box 20 configured to store collected dust therein is generally positioned above the battery 10. A suction fan 30 for providing a driving power to suck dust of the cleaning area is provided at the robot cleaner. The suction fan 30 sucks filth or dirt generated as the agitator 40 mounted to a bottom surface of the robot cleaner main body is rotated.

When compared with a general vacuum cleaner, the robot cleaner has a degraded suction force due to limitations of a size, a battery performance, etc. Accordingly, recently required is a robot cleaner having a strong suction force. For this, the motor for driving the suction fan 30 has to have an increased capacity. However, this may increase power consumption and noise. Furthermore, a large amount of battery is required for long usage time.

FIG. 2 is a view showing a lower part of the robot cleaner in accordance with the conventional art. Referring to FIG. 2, side brushes 50 configured to enhance a cleaning performance at areas adjacent to a wall surface, as well as the agitator 40 are provided at a lower part of the robot cleaner main body. The side brushes 50 are mounted at both sides of the lower part of the robot cleaner main body, and collect dust, etc. on the floor into the robot cleaner main body by being rotated centering around a rotation shaft disposed in upper and lower directions. In the conventional art, side brush driving motors 60 configured to drive the side brushes 50 are provided at the side brushes 50, respectively. Accordingly, an agitator driving motor has to be separately implemented from the motor for driving the plurality of side brushes. This may increase the number of components, and cause the robot cleaner to have a complicated inner structure.

In the conventional robot cleaner, a guide vane or a scroll for increasing a pressure is installed around the suction fan. However, this may cause the driving motor to be operated with a higher rpm, and cause a flow path to have a complicated structure. As a result, a flow resistance is increased, and thus noise is also increased.

More concretely, as shown in FIG. 3, air sucked in an axial direction of the suction fan is provided with a flowing force by the suction fan 31, and is guided by a guide vane 33 thus to move along the arrow of the drawing. Reference numeral 35 indicates a motor which provides a rotational force to the fan 31. In the case of installing the guide vane around the suction fan for pressure increase and air guidance, the suction fan has to be rotated with a high rpm so as to provide a sufficient suction force and flow amount. This may require high power consumption, and cause large noise.

FIG. 4 shows another example of the suction fan. Referring to FIG. 4, air sucked in an axial direction of the suction fan is provided with a flowing force by the suction fan 41, and is guided by a scroll 43 thus to be discharged to one side. Reference numeral 45 indicates a motor which provides a rotational force to the suction fan 41. In the case of using the scroll, the suction fan has a large size due to a structure of the scroll. Furthermore, if the suction fan is rotated with a high speed, large noise may be caused.

SUMMARY OF THE INVENTION

Therefore, an object of the present invention is to provide a robot cleaner capable of increasing a suction force without increasing a capacity of a motor which drives a suction fan.

To achieve these and other advantages and in accordance with the purpose of the present invention, as embodied and broadly described herein, there is provided a robot cleaner, comprising: a main body having a suction port at a bottom surface thereof; a pair of wheel assemblies disposed at both sides of the main body, and configured to move the main body; a dust box installed on the bottom surface of the main body, and configured to collect dust sucked through the suction port; a filter unit configured to filter air discharged from the dust box; a suction fan configured to form a suction pressure on a suction channel defined by the suction port, the dust box and the filter unit; and a battery disposed at a side of the dust box.

The suction pressure may be increased by minimizing a resistance of the suction channel from the suction port to the suction fan, instead of increasing a motor which drives the suction fan. More concretely, differently from the conventional art in which the dust box is disposed above the battery, the dust box may be disposed to contact the bottom surface of the main body. This may reduce a length of the suction channel from the suction port to the dust box, and thus reduce a flow resistance. This may increase the suction pressure without changing the suction fan and the motor.

The dust box is mounted on the bottom surface of the main body, alternatively, the dust box may directly contact the bottom surface of the main body, or the dust box is spaced from the bottom surface of the main body with having no components interposed therebetween. Further, the dust box partially contacts the bottom surface of the main body.

The battery may be positioned above the dust box. However, in this case, the robot cleaner may run with lowered stability. Accordingly, the battery may be preferably disposed on a side surface of the dust box. Disposing the battery on the side surface of the dust box may mean overlapping the dust box and the battery in a horizontal direction of the main body.

A balance weight facing the battery with the dust box therebetween may be installed in the main body so as to allow the robot cleaner to have a uniform weight balance.

The dust box may be disposed between the pair of wheel assemblies, and the battery may be mounted between the pair of wheel assemblies.

A length of the battery with respect to a vertical direction of the main body may be longer than that with respect to a horizontal direction of the main body.

The robot cleaner may further comprise an agitator rotatably mounted to a lower part of the main body, side brushes mounted so as to be rotatable with a rotation shaft extending in a vertical direction of the main body, and a driving force transmission device configured to transmit a rotational force of the agitator to the side brushes. The agitator and the side brushes may be simultaneously driven through one actuator, e.g., the motor without using an additional actuator. In this case, the driving force transmission device may comprise worms and worm gears.

The suction fan may comprise a plurality of wings configured to introduce air in an axial direction, and to discharge the air to a radial direction, and a shroud having a suction port disposed in front of the wings in the axial direction, and having a discharge port formed in a ring shape in a circumferential direction of the wings.

In the configuration, air may be introduced in an axial direction and then be discharged to a radial direction, and the shroud may have a discharge port formed in a ring shape. This may allow a flow resistance to be more reduced than in the conventional art.

In an assumption that a virtual circle has a shortest distance from an axial center of the suction fan to the wing as a radius, and an angle formed between a tangent of the virtual circle and a tangent of the wing at an intersection point between the virtual circle and the wing is an inlet angle, the inlet angle may be in the range of 17.5°~22.5°.

In an assumption that a virtual circle has a longest distance from the axial center of the suction fan to the wing as a radius, and an angle formed between a tangent of the virtual circle and a tangent of the wing at an intersection point between the virtual circle and the wing is an outlet angle, the outlet angle may be in the range of 20.5°~25.5°.

The shroud may include a tapered surface having a gradually-increased radius at a front surface thereof, and the tapered surface may have an angle of 17.5°~22.5°.

The filter unit may include a filter case which forms a part of the suction channel, a first filter disposed at an inlet of the filter case, and a second filter disposed at an outlet of the filter case. One or more bypass holes penetrating a side wall of the filter case may be formed at the filter unit.

If dust is accumulated in the dust box for a long time, the filter of the dust box may be blocked to increase a flow resistance. In order to prevent this, the dust box has to be made to be empty frequently. In the present invention, drastic increase of a flow resistance may be minimized by forming the bypass hole to which air is introduced when the filter is blocked. That is, the bypass hole may be formed on a side surface of the filter case which forms a part of the suction channel. When the first filter is in a normal state, most of air may pass through the first filter. On the other hand, when the first filter is blocked to some degrees, air may be introduced into the bypass hole.

A flow amount through the bypass hole may be set to be less than that through the first filter. The first filter may include a mesh filter, and a mesh filter having mesh holes smaller than those of the mesh filter of the first filter may be installed at the bypass hole.

In the above configurations, a suction pressure may be increased without increasing a battery or a capacity of the driving motor which drives the suction fan.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the present invention, with reference to the accompanying drawings.

For the sake of brief description with reference to the drawings, the same or equivalent components will be provided with the same reference numbers, and description thereof will not be repeated.

Hereinafter, preferred embodiments of the present invention will be explained in more detail with reference to the attached drawings. Detailed explanations about similar configurations to the conventional configurations will be omitted.

Figure 1:
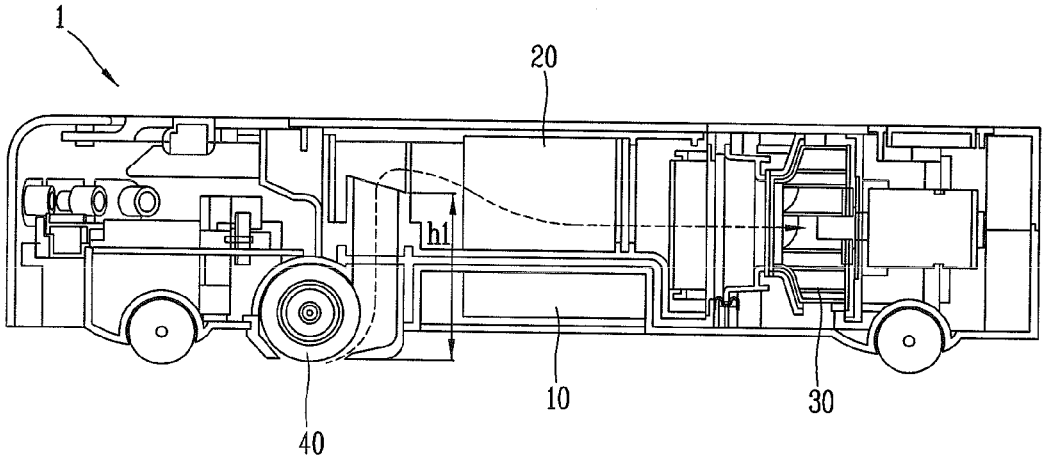
FIG. 1 CONVENTIONAL ART
FIG. 1 is a side sectional view of a robot cleaner in accordance with the conventional art.
Figure 2:
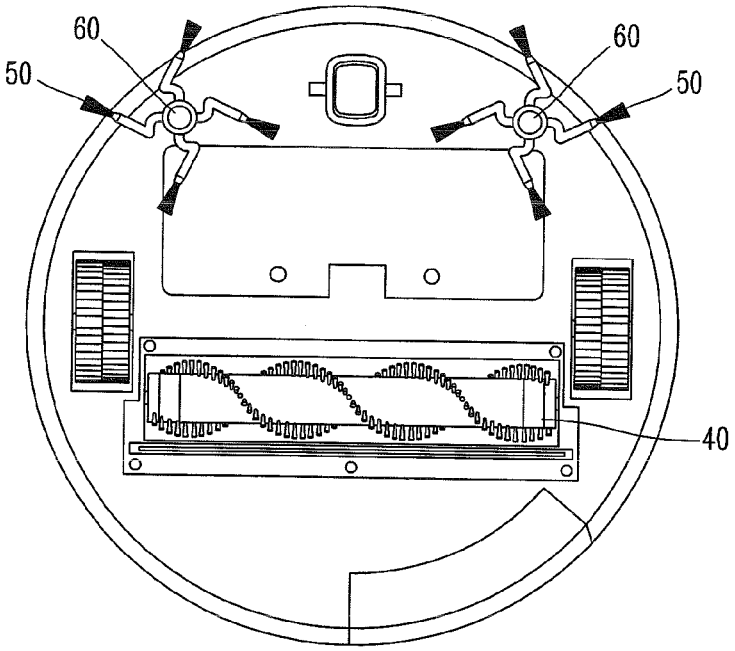
FIG. 2 CONVENTIONAL ART
FIG. 2 is a view showing a lower part of the robot cleaner in accordance with the conventional art.
Figure 3:
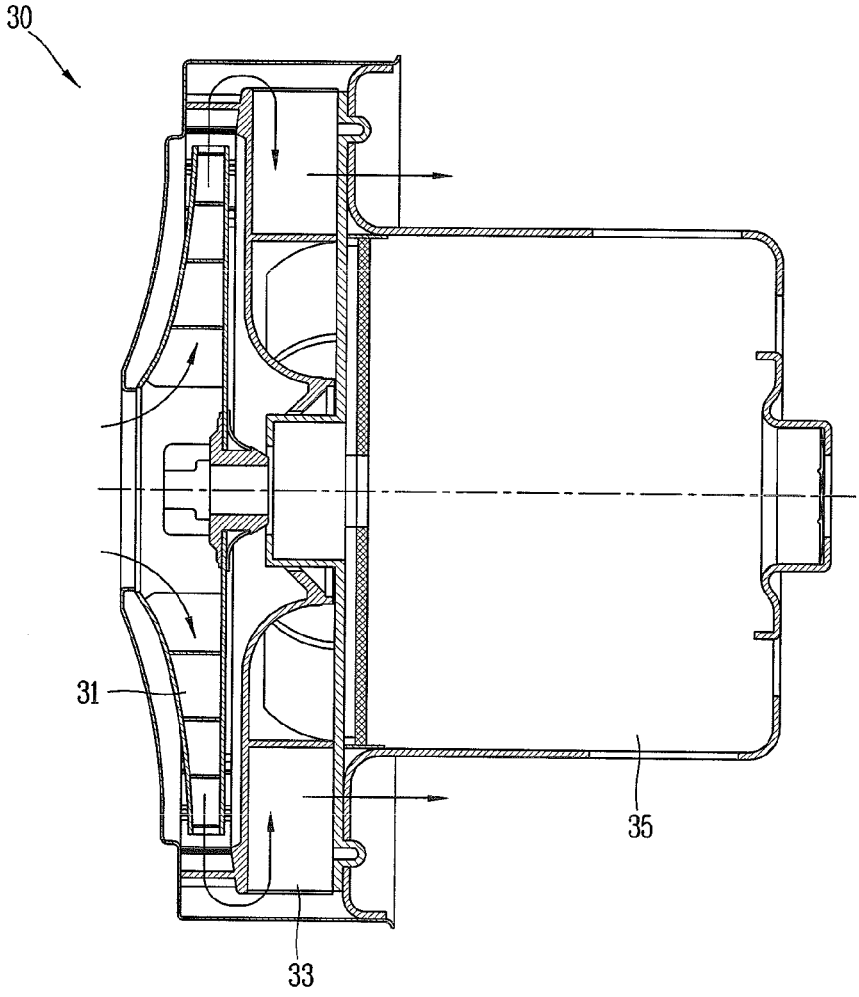
FIG. 3 CONVENTIONAL ART
FIG. 3 is a view showing one shape of a suction fan of the robot cleaner in accordance with the conventional art.
Figure 4:
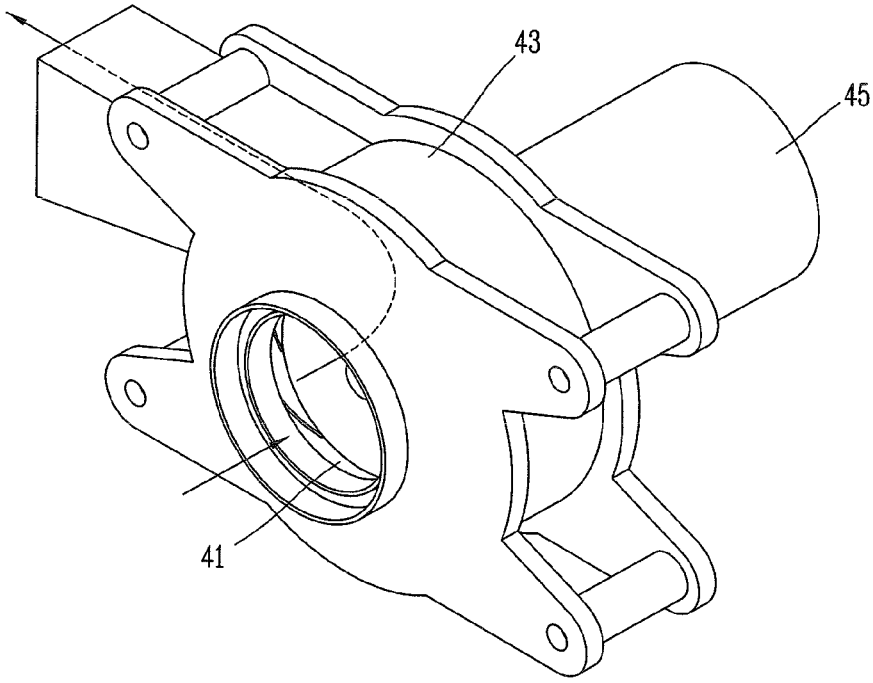
FIG. 4 Conventional Art
FIG. 4 is a view showing another shape of the suction fan of the robot cleaner in accordance with the conventional art.
Figure 5:
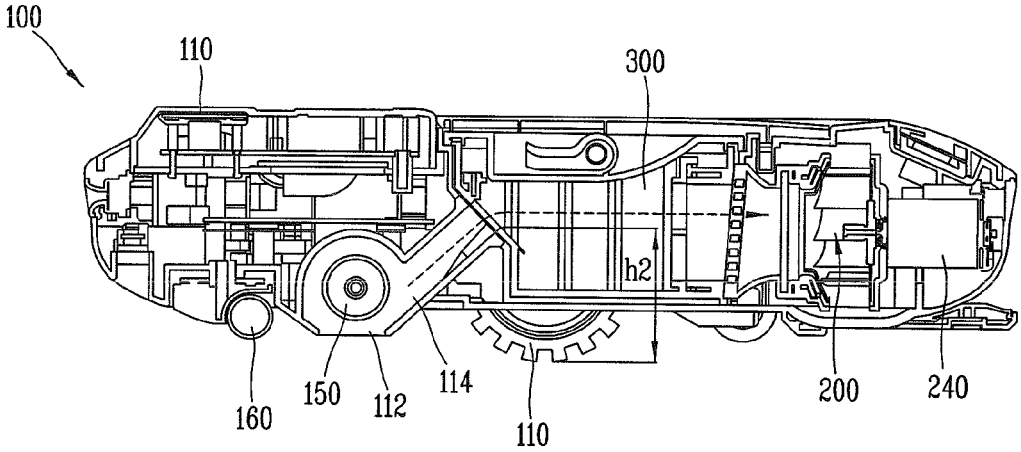
FIG. 5 is a side sectional view of a robot cleaner according to one embodiment of the present invention.
Figure 6:
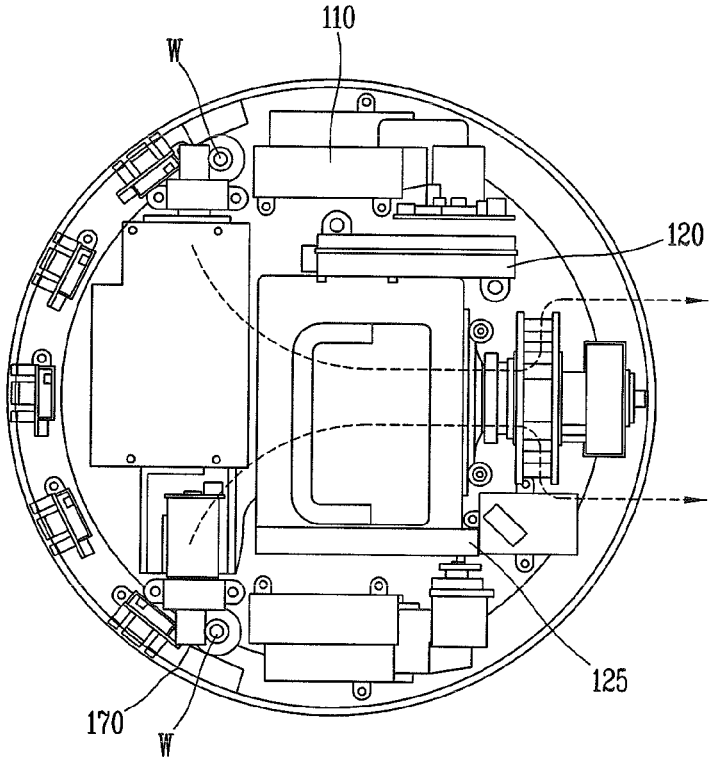
FIG. 6 is a planar view showing inside of the robot cleaner of FIG. 5.
Figure 7:
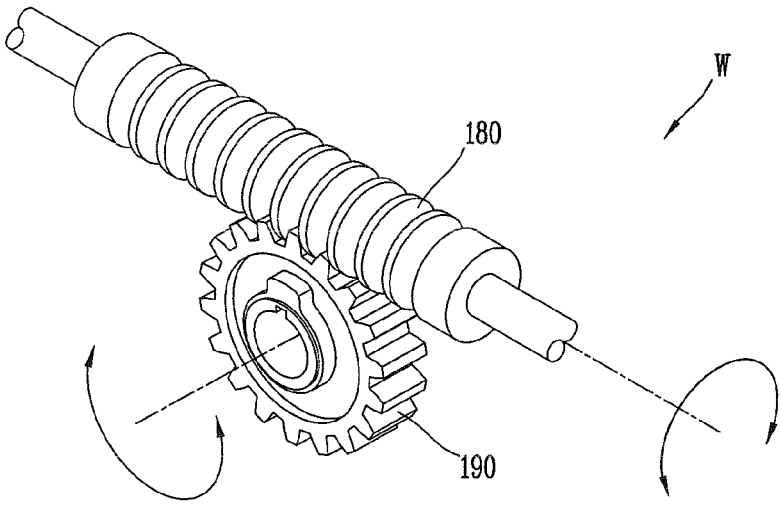
FIG. 7 is an enlargement view showing inside of a part 'W' of FIG. 6.

FIG. 5 is a side sectional view of a robot cleaner according to one embodiment of the present invention, FIG. 6 is a planar view showing inside of the robot cleaner of FIG. 5, and FIG. 7 is an enlargement view showing inside of a part 'W' of FIG. 6.

First of all, directions disclosed in the specification will be defined. When wheels of both sides of the robot cleaner are simultaneously rotated, a direction to which the robot cleaner is forwardly moving is referred to as a 'front side', and a direction opposite to the front side is referred to as a 'rear side'. Lateral directions of the front and rear sides are referred to as 'right and left directions'. And, a direction perpendicular to a main body, i.e., a direction perpendicular to a floor where the robot cleaner is positioned is referred to as 'upper and lower directions'.

Referring to FIGS. 5 and 6, the robot cleaner 100 according to one embodiment of the present invention comprises a wheel assembly 110 provided at both sides of a lower part of a main body 100 and configured to move the main body, a battery 120 mounted to one of right and left sides of the main body 110, and a dust box 300 mounted to a central lower part of the main body and configured to store sucked dust therein. The robot cleaner 100 according to the present invention further comprises a suction fan assembly 200 configured to provide a driving force to suck dust in a cleaning area, an agitator 150 mounted to a bottom surface of a lower part of the main body, and a caster 160 configured to support the main body together with the wheel assembly 110 at the lower part of the main body.

A suction port 112 is formed at one side of the bottom surface of the main body 110, and the agitator 150 is installed in the suction port 112. The suction port 112 is communicated with a suction pipe 114 extending to a right upward side with an inclination angle based on FIG. 5, and the suction pipe 114 is formed to be communicated with the dust box 300 to be later explained. Since the suction pipe 114 forms a part of a suction channel, a height (h2) of the end of the suction pipe 114 influences on a length of the suction channel.

In order to prevent backflow of dust collected in the dust box 300, the suction pipe 114 has to be spaced from a bottom surface of the dust box 300 by a predetermined height. Accordingly, a height of an outlet of the suction pipe 114 corresponds to a value obtained by adding a distance between the wheel 110 and the bottom surface of the main body 110 to a height of the outlet of the suction pipe from the bottom surface of the dust box.

In the present invention, the battery 120 is installed not a central lower part of the main body, but a part inclined to right and left sides from the central lower part of the main body. Accordingly, the dust box 300 of the robot cleaner according to the present invention may be positioned at a lowest end of the main body, which is different from the conventional robot cleaner. This may allow the dust box 300 to have a low installation height. As a result, a height (h2) of the inlet of the dust box, i.e., a height of the outlet of the suction pipe 114 from a bottom surface of the robot cleaner is also lowered. Preferably, a rectangular battery is uprightly installed. More concretely, the battery is positioned on a side surface of the dust box 300 in a state that a surface of the battery is in parallel to the wheel assembly 110.

The battery 120 has a nearly rectangular parallelepiped, and two surfaces having a largest area among six surfaces are aligned in right and left directions of the main body. Under these configurations, an area occupied by the battery 120 on the bottom surface of the main body can be reduced, and thus an installation space for the dust box 300 can be obtained.

According to the present invention, since the dust box is installed at a lower height, the inlet of the dust box has a low height. This may allow the robot cleaner to perform the same cleaning performance with a low suction force, thereby significantly reducing a battery capacity and size.

A plumb bob 125 may be installed at one of right and left sides of the main body so as to prevent a weight bias phenomenon of the main body occurring as the heavy battery is mounted to one of right and left sides of the main body. A weight, a size, and an installation position of the plumb bob may be properly controlled with consideration of a weight of the battery. The plumb bob 125 may be mounted to another side of the right and left sides of the main body, said another side facing one side where the battery has been mounted.

Preferably, the battery is mounted to an inner side surface of one wheel of two wheels provided at right and left sides of the main body, whereas the plumb bob is mounted to an inner side surface of another wheel.

The robot cleaner 100 according to the present invention further comprises an agitator 150 rotatably mounted to a lower part of the main body, and side brushes 170 configured to clean a wall surface, corners, etc. of a cleaning region by being rotated centering around a rotation axis disposed in upper and lower directions of the main body. The agitator 150 serves to brush up dust on the floor by being rotated centering around a shaft disposed in right and left directions of the main body. And, the side brushes 170 collect dust onto corners by being rotated centering around a shaft disposed in upper and lower directions of the main body. The agitator and the side brushes are rotated centering around the shafts different from each other. Accordingly, the conventional robot cleaner has to be provided with separate driving motors.

However, in the present invention, one motor (not shown) for driving the agitator is provided to drive the side brushes together. That is, a driving power of the agitator is transmitted to the side brushes. For this, as shown in FIG. 6, the side brushes 170 are disposed at both sides of the agitator 150, and a driving power transmission means configured to transmit a rotational force of the agitator 150 to the side brushes 170 is provided between the agitator 150 and the side brushes 170.

As the driving power transmission means, worms and worm gears may be used, or belts may be used. FIG. 7 shows a driving power transmission method using worms and worm gears. Referring to FIG. 7, a shaft of a worm 180 is connected to a shaft of the agitator 150, and a shaft of a worm gear 190 is connected to a shaft of the side brush 170. In a state that the shaft of the agitator and the shaft of the side brush are perpendicular to each other, a rotational force of the agitator is transmitted to the shaft of the side brush. An rpm of the agitator 150 and an rpm of the side brush 170 can be properly controlled by controlling a gear ratio between the worm 180 and the worm gear 190.

Figure 8:
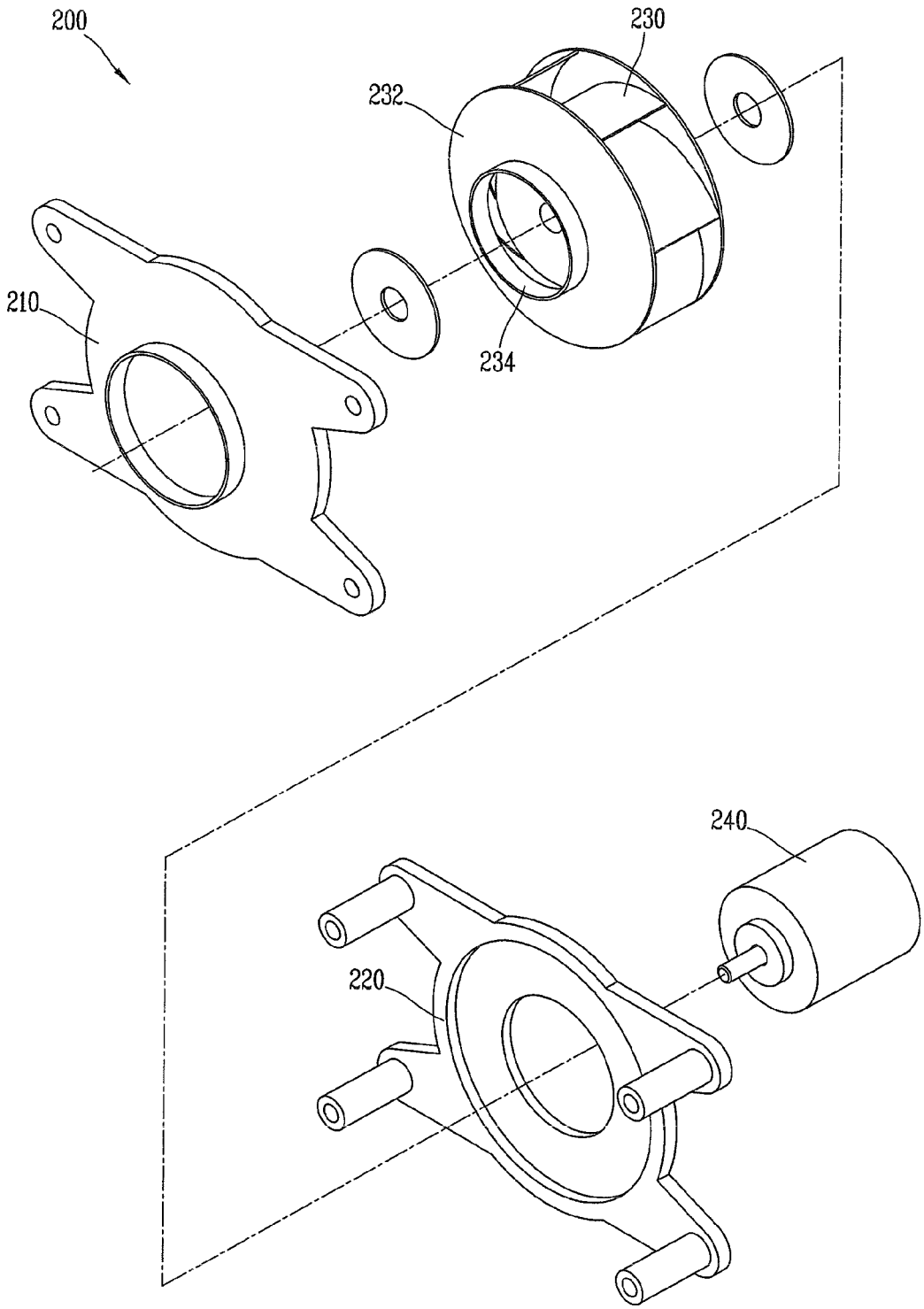
FIG. 8 is a disassembled perspective view of a suction fan assembly of the robot cleaner according to one embodiment of the present invention.
Figure 9:
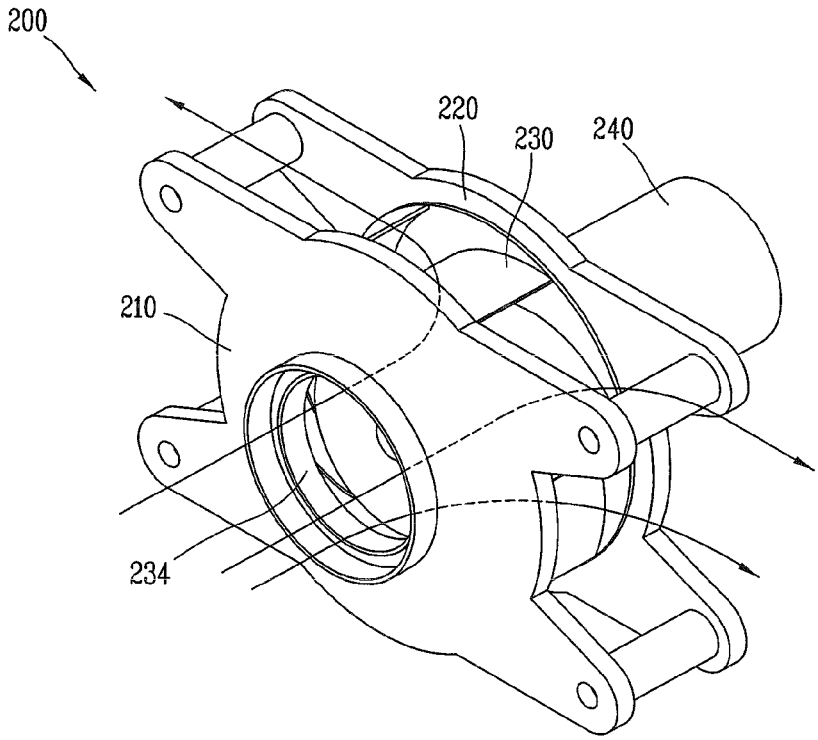
FIG. 9 is an assembled perspective view of the suction fan assembly of FIG. 8.

Hereinafter, the suction fan assembly 200 will be explained with reference to FIG. 8. FIG. 8 is a disassembled perspective view of the suction fan assembly 200, and FIG. 9 is an assembled perspective view of the suction fan assembly 200. The suction fan assembly 200 includes a first case 210 having a suction port at a middle portion thereof, a second case 220 coupled to the first case 210, a shroud 232 coupled to the first case 210, a plurality of wings 230 rotatably installed in the shroud 232, and a motor 240 configured to drive the plurality of wings 230. The suction fan assembly 200 serves to exhaust, by the plurality of wings 230 being rotated, air having been introduced through the suction port 234 formed at a central part of the shroud 232, in a direction perpendicular to the introduction direction (i.e., a radius direction). This air flow is indicated by the arrow in FIG. 9.

Figure 10:
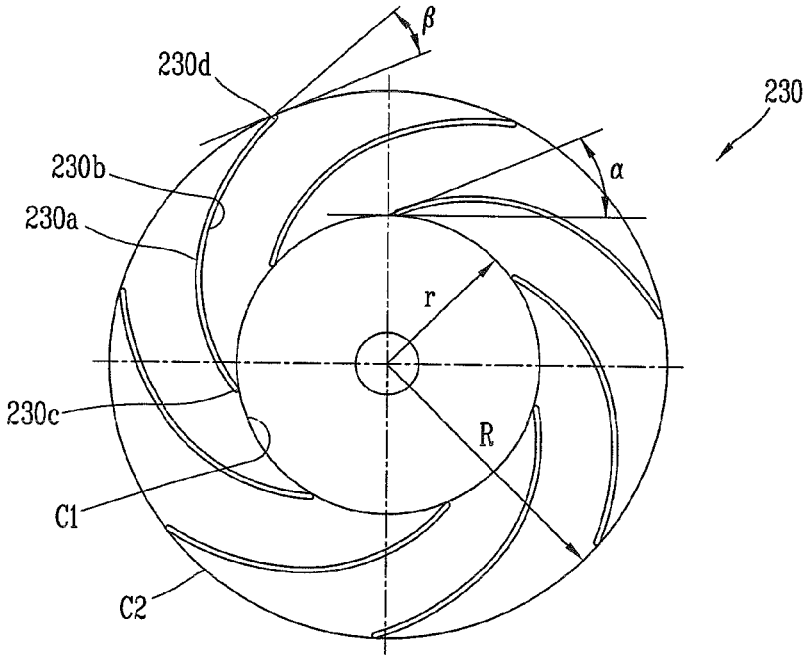
FIG. 10 is a front sectional view of the suction fan assembly according to one embodiment of the present invention.

The suction fan assembly 200 is a centrifugal fan configured to exhaust air introduced in an axial direction, to a direction perpendicular to a shaft. FIG. 10 is a front sectional view of the plurality of wings, and FIG. 11 is a side sectional view of the suction fan assembly 200.

Figure 11:
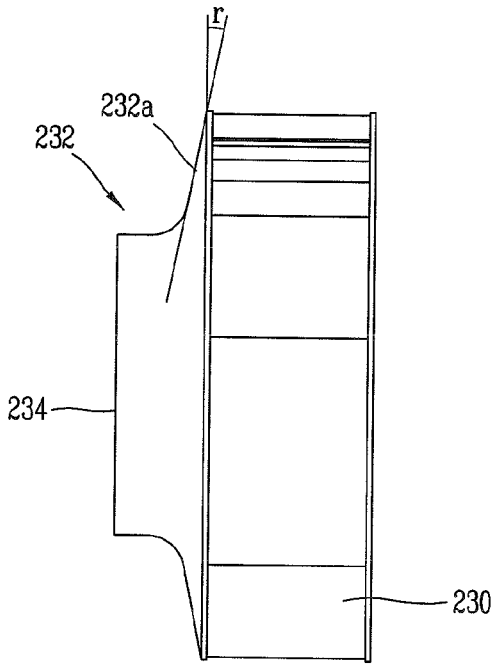
FIG. 11 is a side sectional view of the suction fan assembly of FIG. 10.

Referring to FIGS. 10 and 11, the suction fan assembly 200 includes a plurality of wings 230 configured to make air flow. The wings 230 include a pressure surface 230*a* configured to push air, and a side pressure surface 230*b* corresponding to a rear surface of the pressure surface 230*a*, and having a pressure lower than an atmospheric pressure. The wings 230 also includes a front end portion 230*c* formed at a shaft of the motor 240 and frictional with introduced air, and a rear end portion 230*d* formed at an outer circumference of the wings 230 and configured to discharge air. The plurality of wings 230 are positioned between a virtual circle (C1) having a length from the shaft of the motor 240 to the front end portion 230*c* as a radius (r), and a virtual circle (C2) having a distance from the shaft of the motor 240 to the rear end portion 230*d* as a radius (R).

An angle formed as a tangent of the circle (C1) and a tangent of the wing 230 meet at an intersection point between the circle (C1) and the wing 230 is referred to as an inlet angle ($\alpha$). In the present invention, the inlet angle is in the range of 20°±2.5°. An angle formed as a tangent of the circle (C2) and the wing 230 meet at an intersection point between the circle (C2) and the wing 230 is referred to as an outlet angle ($\beta$). In the present invention, the outlet angle is in the range of 23°±2.5°.

Parts of the shroud 232 rather than the suction port 234 are implemented as a tapered surface 232*a*. The tapered surface 232*a* has a diameter gradually increased towards a downstream side from an upstream side of air. With regards to the shape of the tapered surface 232*a*, a part where the motor shaft has a minimized radius is formed in a curved line, whereas a part where the motor shaft has a maximized radius ('outermost part of the shroud') is formed in a straight line. An angle between a line perpendicular to the motor shaft and the shroud at the outermost part is referred to as a shroud angle ($\gamma$). In the present invention, the shroud angle ($\gamma$) is in the range of 17.5°~22.5°.

Figure 12:
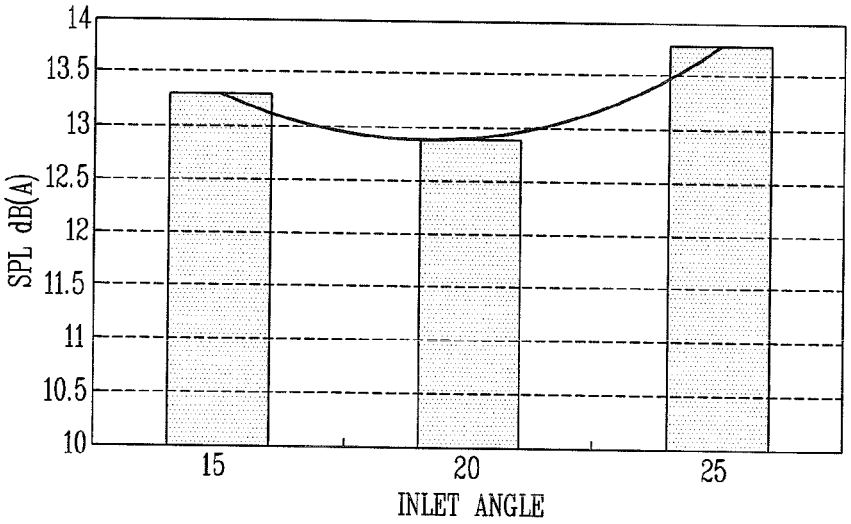
FIG. 12 is a graph showing a relation between changes of an inlet angle of the suction fan assembly of FIG. 10 and noise.
Figure 13:
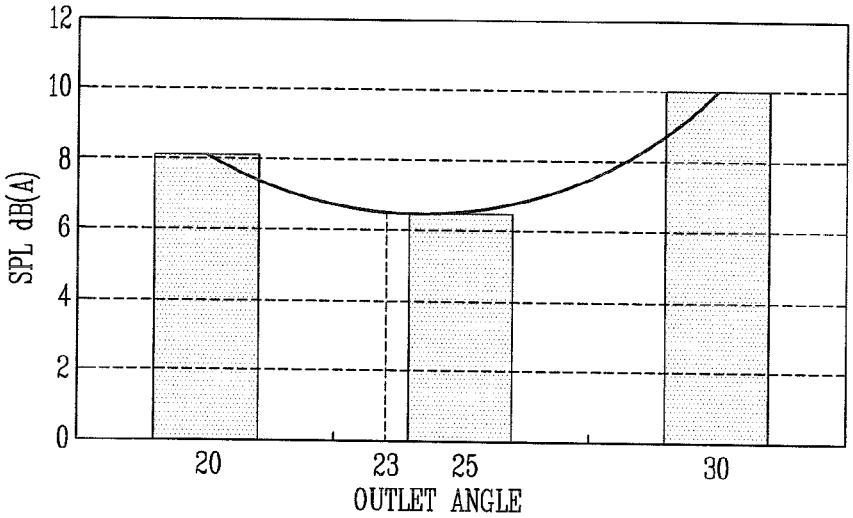
FIG. 13 is a graph showing a relation between changes of an outlet angle of the suction fan assembly of FIG. 10 and noise.
Figure 14:
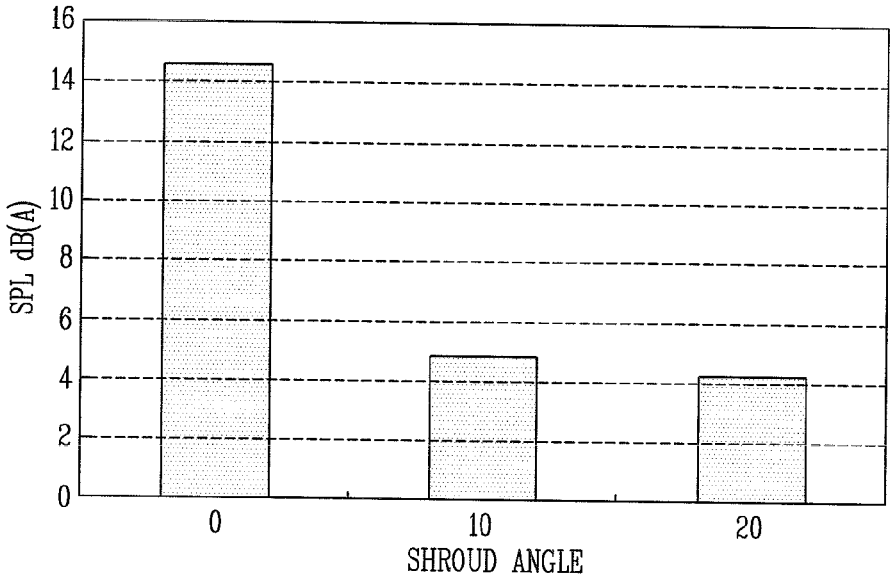
FIG. 14 is a graph showing a relation between a shroud angle of the suction fan assembly of FIG. 10 and noise.

FIG. 12 is a graph showing a relation between changes of the inlet angle of the suction fan assembly and noise, FIG. 13 is a graph showing a relation between changes of the outlet angle of the suction fan assembly and noise, and FIG. 14 is a graph showing a relation between the shroud angle of the suction fan assembly and noise. Referring to the graphs, noise of the suction fan assembly is minimized at the inlet angle, the outlet angle, and the shroud angle, each angle within the range defined in the present invention.

Figure 15:
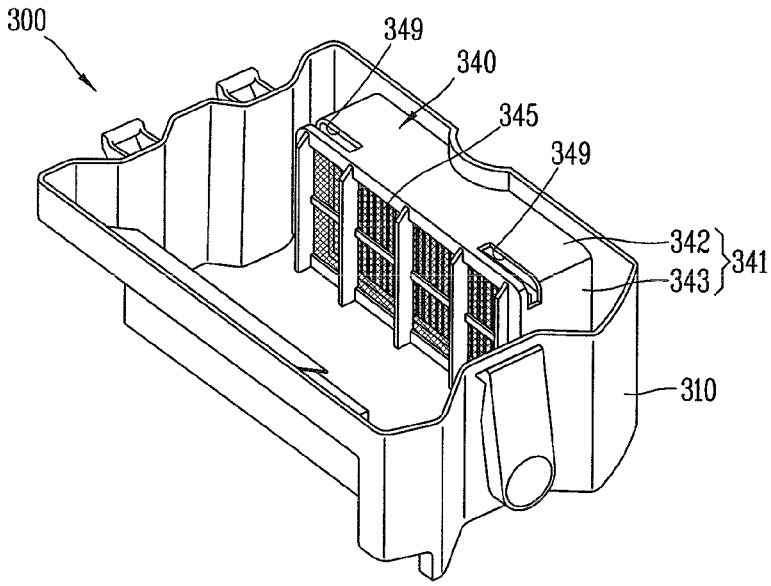
FIG. 15 is a view of a dust box of the robot cleaner according to one embodiment of the present invention.
Figure 16:
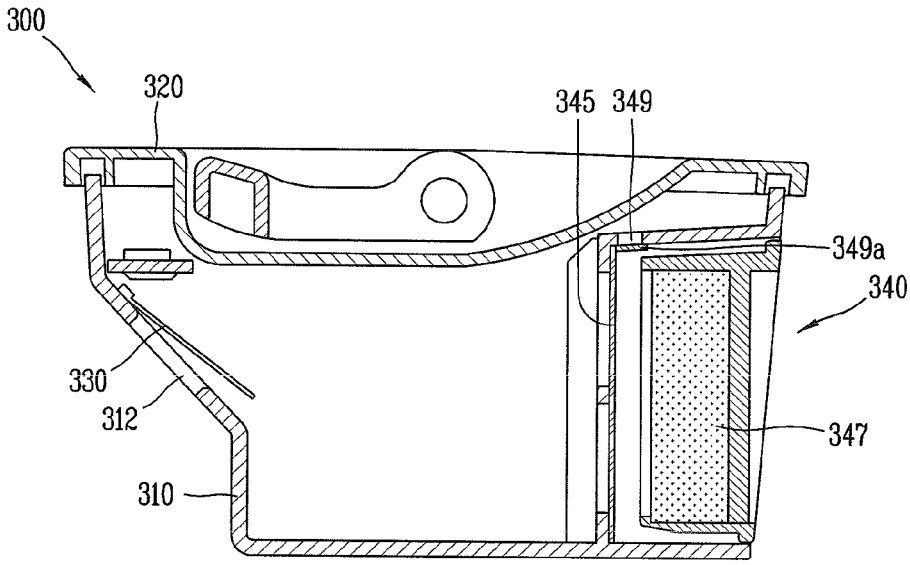
FIG. 16 is a side sectional view of the dust box of the robot cleaner according to one embodiment of the present invention.

FIG. 15 is a perspective view of the dust box 300, and FIG. 16 is a sectional view of the dust box 300. Referring to FIGS. 15 and 16, the dust box 300 includes a dust box body 310 which constitutes a body of the dust box 300, and a cover 320 configured to open and close the body from an upper side. Inside the dust box body 310, there is formed an inlet 312 to which dust-included air is introduced from outside. The inlet 312 is covered by a check valve 330. The inlet 312 is communicated with the aforementioned suction pipe 114, and air sucked through the inlet 312 passes through a filter unit 340 provided at a rear side of the dust box 300 before being discharged from the robot cleaner. Filth or dust included in the air sucked into the dust box is stored in the dust box after being filtered by the filter unit 340, and the air sucked into the dust box with the dust is exhausted outside the robot cleaner through the filter.

The filter unit 340 includes a filter case 341 formed in an approximate rectangular shape having an upper surface 142 and side surfaces 143. Front and rear surfaces of the filter case 341 are opened to form a part of the suction channel. A first filter 345 is positioned on a front surface of the filter case 341, and a second filter 347 is positioned on a rear surface of the filter case 341. As the first and second filters, may be used any filter among a mesh filter, a HEPA filter, a non-woven fabric and a paper filter, or a combination of at least two of the filters. In the preferred embodiment, a mesh filter is used as the first filter 345, and a HEPA filter is used as the second filter 347.

In order to prevent decrease a suction force due to a filter clogging phenomenon, the filter unit of the present invention has a dual filter structure using fine (dense) mesh and HEPA filters. Bypass holes 349 are provided on an upper side or side surfaces of the filter case 341. The bypass holes 349 are provided on an upper surface or side surfaces of the filter case 341, rather than a front surface or a rear surface of the filter case 341, and are positioned to be parallel to the suction channel. Accordingly, a larger amount of sucked air is discharged out through the first filter 345, and a smaller amount of air is discharged out through the bypass hole 349. For this, the bypass hole 349 has an area smaller than that of the first filter, preferably, an area equal to or less than a half of an area of the first filter.

The bypass hole 349 may be provided on either an upper surface 342 or side surfaces 343 of the filter unit, or both of the upper surface 342 and the side surfaces 343.

Like the first filter 345, the bypass hole 349 is provided with a bypass filter 349*a* implemented as a mesh filter. Under these configurations, air having been introduced into the check valve 330 of the dust box 300 is discharged to the outside through the filter unit 340 of the dust box 300. The discharged air firstly passes through the first filter 345, such that dust having a large lump is firstly filtered. Then, the air having passed through the first filter 345 passes through the second filter 347, such that dust having a relatively small size is removed and then the air is discharged to the outside of the filter unit, i.e., the outside of the body of the robot cleaner. However, a part of the air having been introduced into the dust box does not pass through the first filter 345, but passes through the second filter 347 via the bypass filter 349*a* thus to be discharged to the outside of the body of the robot cleaner.

Owing to the bypass filter, dust included in the air having been introduced into the dust box is prevented from being concentratedly accumulated on the first filter 345 disposed on a front surface of the filter unit, and a suction force required to perform a cleaning process is continuously maintained.

Preferably, the mesh hole of the bypass filter 349*a* has a size larger than that of the mesh hole of the first filter. This may allow a part of the air having been sucked into the dust box to be more smoothly bypassed. The size of the mesh hole of the bypass filter 349*a* is preferably less than 60-mesh, and the size of the mesh hole of the first filter 345 is preferably more than 70-mesh. When the size of the mesh hole is 60-mesh, it means that the number of openings formed at a region corresponding to 1 cm×1 cm of the mesh filter is 60.

Under these configurations, in a case that dust is sucked to be stored in the dust box while the robot cleaner cleans an indoor floor, may be prevented a clogging phenomenon of the first filter due to concentrative accumulation of the dust on the first filter 345. Furthermore, even if the first filter 345 is clogged due to concentrative accumulation of the dust thereon, air is introduced into the filter unit through the bypass filter installed on the upper surface or the side surface of the filter unit, and then is discharged to the outside through the second filter. Accordingly, the suction force of the robot cleaner may be continuously maintained.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A robot cleaner, comprising:

a main body having a suction port at a bottom surface thereof;

a pair of wheel assemblies disposed at both sides of the main body, and configured to move the main body;

a dust box installed on the bottom surface of the main body, and configured to collect dust sucked through the suction port;

a filter unit configured to filter air discharged from the dust box;

a suction fan configured to form a suction pressure on a suction channel defined by the suction port, the dust box and the filter unit; and a battery disposed at a side of the dust box;

an agitator rotatably mounted to a lower part of the main body;

side brushes mounted so as to be rotatable with a rotation shaft extending in a vertical direction of the main body; and a driving force transmission device configured to transmit a rotational force of the agitator to the side brushes, wherein the dust box is disposed between the suction port and the filter unit with respect to a longitudinal direction of the main body.

2. The robot cleaner of claim 1, wherein a balance weight facing the battery with the dust box therebetween is installed in the main body.

3. The robot cleaner of claim 1, wherein the dust box is disposed between the pair of wheel assemblies.

4. The robot cleaner of claim 3, wherein the battery is mounted between the pair of wheel assemblies.

5. The robot cleaner of claim 4, wherein a length of the battery with respect to a vertical direction of the main body is longer than that with respect to a horizontal direction of the main body.

6. The robot cleaner of claim 1, wherein the driving force transmission device comprises worms and worm gears.

7. The robot cleaner of claim 1, wherein the suction fan comprises:

a plurality of wings configured to introduce air in an axial direction, and to discharge the air to a radial direction; and a shroud having a suction port disposed in front of the wings in the axial direction, and having a discharge port formed in a ring shape in a circumferential direction of the wings.

8. The robot cleaner of claim 1, wherein the filter unit comprises:

a filter case configured to form a part of the suction channel;

a first filter disposed on a suction port side of the filter case; and a second filter disposed on a discharge port side of the filter case, wherein one or more bypass holes are penetratingly formed on a side surface of the filter case.

9. The robot cleaner of claim 8, wherein a flow rate through the bypass hole is set to be less than a flow rate through the first filter.

10. The robot cleaner of claim 8, wherein the first filter comprises a mesh filter, and a mesh filter having mesh holes smaller than those of the mesh filter of the first filter is installed at the bypass hole.

11. A robot cleaner, comprising:

a main body having a suction port at a bottom surface thereof;

a pair of wheel assemblies disposed at both sides of the main body, and configured to move the main body;

a dust box installed on the bottom surface of the main body, and configured to collect dust sucked through the suction port;

a filter unit configured to filter air discharged from the dust box;

a suction fan configured to form a suction pressure on a suction channel defined by the suction port, the dust box and the filter unit;

a battery disposed at a side of the dust box;

an agitator rotatably mounted to a lower part of the main body;

side brushes mounted so as to be rotatable with a rotation shaft extending in a vertical direction of the main body; and a driving force transmission device configured to transmit a rotational force of the agitator to the side brushes.

12. The robot cleaner of claim 11, wherein the driving force transmission device comprises worms and worm gears.

* * * * *